US009051035B2

(12) United States Patent
Imel et al.

(10) Patent No.: US 9,051,035 B2
(45) Date of Patent: Jun. 9, 2015

(54) BENCH SYSTEM FOR SMALL WATERCRAFT BOATLIFT

(75) Inventors: Dustin Imel, Rocky Comfort, MO (US); David J. Sturtevant, Caro, MI (US)

(73) Assignee: E-Z-DOCK, INC., Monett, MO (US)

( * ) Notice: Subject to any disclaimer, the term of this patent is extended or adjusted under 35 U.S.C. 154(b) by 1135 days.

(21) Appl. No.: 12/780,473

(22) Filed: May 14, 2010

(65) Prior Publication Data

US 2010/0247243 A1 Sep. 30, 2010

Related U.S. Application Data

(63) Continuation-in-part of application No. 12/557,278, filed on Sep. 10, 2009, now Pat. No. 8,256,366.

(60) Provisional application No. 61/192,142, filed on Sep. 16, 2008.

(51) Int. Cl.
*B63B 17/00* (2006.01)
*B63C 3/02* (2006.01)

(52) U.S. Cl.
CPC ..... *B63C 3/02* (2013.01)

(58) Field of Classification Search
USPC ..... 114/362, 45, 48, 258, 263; 414/139.5, 414/537, 921; 5/81.1 HS, 81.1 C, 81.1 R; 4/589, 590, 547, 548, 560.1, 561.1, 4/571.1, 578.1, 579; 296/26.09, 61, 62; 297/143, 188.11, 236, 237, 239, 423.2, 297/423.21; 108/91, 92, 143; 312/235.1, 312/235.2; 405/1–3
See application file for complete search history.

(56) References Cited

U.S. PATENT DOCUMENTS

| | | | | | |
|---|---|---|---|---|---|
| 1,508,259 | A | * | 9/1924 | Stafford | 312/195 |
| 2,628,879 | A | * | 2/1953 | Schultz | 312/235.5 |
| 2,988,753 | A | * | 6/1961 | Corvelli | 4/523 |
| 4,733,898 | A | * | 3/1988 | Williams | 296/24.32 |
| 4,900,217 | A | * | 2/1990 | Nelson | 414/537 |
| 4,975,991 | A | * | 12/1990 | Peterson | 4/579 |
| 5,281,055 | A | | 1/1994 | Neitzke | |
| 5,823,368 | A | * | 10/1998 | Burke et al. | 211/175 |
| 6,006,687 | A | | 12/1999 | Hillman et al. | |
| 6,840,188 | B1 | | 1/2005 | Witbeck | |
| 7,100,527 | B2 | | 9/2006 | Munro | |
| 7,243,608 | B2 | | 7/2007 | Knight, Jr. | |
| 7,293,522 | B1 | | 11/2007 | Elson | |
| 7,488,025 | B1 | * | 2/2009 | Roberson | 296/61 |
| 7,549,692 | B2 | * | 6/2009 | Washington | 296/61 |
| 7,562,402 | B1 | * | 7/2009 | Calloway et al. | 4/572.1 |
| 2005/0172876 | A1 | | 8/2005 | Ostreng et al. | |
| 2006/0272566 | A1 | | 12/2006 | Rueckert | |
| 2006/0279182 | A1 | * | 12/2006 | Chi Ming | 312/219 |
| 2009/0044739 | A1 | | 2/2009 | Imel | |
| 2009/0044740 | A1 | | 2/2009 | Imel | |
| 2009/0145345 | A1 | | 6/2009 | Newcomb | |

* cited by examiner

*Primary Examiner* — Sunil Singh
(74) *Attorney, Agent, or Firm* — Polster, Lieder, Woodruff & Lucchesi, L.C.

(57) ABSTRACT

A boatlift for use with small, manual or paddle or oar powered watercraft (such as canoes and kayaks) is provided with a guide rails on either side of the boat lift, which can be utilized by a boater to propel or urge his/her watercraft onto the boatlift. In addition, that boatlift is provided with an entrance/exit assist member which can be used by boaters with impaired leg function to enter and exit from the watercraft. The boatlift can be provided with a bench system which enables disabled persons to more easily enter and exit from small watercraft supported by the boatlift.

28 Claims, 12 Drawing Sheets

BENCH SYSTEM FOR SMALL WATERCRAFT BOATLIFT

CROSS-REFERENCE TO RELATED APPLICATIONS

This application is a continuation-in-part of U.S. application Ser. No. 12/557,278 filed Sep. 10, 2009, entitled "Small Watercraft Boatlift", now U.S. Pat. No. 8,256,366, which, in turn, claims priority to U.S. Provisional App. No. 61/192,142 filed Sep. 16, 2008 and mailed on Sep. 11, 2008, entitled "Small Watercraft Docking Apparatus To Facilitate Boarding And Disembarking". Both of said applications are incorporated herein by reference.

STATEMENT REGARDING FEDERALLY SPONSORED RESEARCH OR DEVELOPMENT

Not Applicable.

BACKGROUND OF THE INVENTION

This disclosure relates generally to docks and/or boatlifts for small watercraft, and in particular to such dock and/or lifts for use manually or paddle powered boats, such as canoes, kayaks, etc.

Boat lifts for small watercraft, such as personal watercraft (PWC's), kayaks, canoes, etc. typically include cradle for the watercraft which is bounded on at least two sides by decking. The boat lift, in turn, is often part of a docking system, which provides lifts for several watercraft. A popular boat lift is sold by EZ Dock, Inc. under the name EZ Port® and EZ Port Max®. However, those who have impaired leg function or are wheel-chair bound such boat lifts find it difficult to board and disembark watercraft when docked in such boat lifts. Additionally, boatlifts, such as the EZ Port and EZ Port Max rely on power from the motor boat motor to propel the watercraft onto the boat lift. It is difficult to product sufficient energy in manually powered (or rowed) watercraft, such as canoes, kayaks, etc. to propel the canoe, kayak, etc. onto the boat lift. Thus, the boater will need to exit or disembark the boat at the dock, and then maneuver the boat around the dock to the boat lift and pull the boat onto the boat lift.

It would therefore be desirable to provide a boat lift for small watercraft which would make it easier for those with impaired leg function or otherwise use a wheel chair to board and disembark from small watercraft. It would also be desirable to provide a boat lift in which oar powered or rowed boats (such as canoes, kayaks, etc. can be driven or propelled onto a boat lift.

BRIEF SUMMARY OF THE INVENTION

A boatlift for manually powered (i.e., paddle or oar powered) watercraft is provided. The boatlift is a floating boatlift which comprises an elongate cradle, decking on opposite sides of the cradle, an entrance ramp to the cradle, a first guide rail positioned on one side of the cradle and a second guide rail positioned on a second side of the cradle opposite the first side. The first and second guide rails each comprise an approach portion which extends rearwardly of the boatlift ramp and a boatlift portion extending along the boatlift cradle. Each the guide rail further comprises at least one grab bar extending generally horizontally along the rail. The at least one grab bar is positioned on the guide rail to be at a height where a boater sitting in a paddle or oar powered watercraft could reach the grab bar. Additionally, the first and second guide rails are spaced apart from each other a distance sufficient to allow a paddle or oar powered boat to pass therebetween, yet allowing a boater to simultaneously grab the grab bars of both the first and second guide rails so that the boater can utilize the grab rails to move the boat between the guide rails. The first guide rail is an inside guide rail and the second guide rail is an outside guide rail. The outside guide rail is longer than the inside guide rail. Specifically, the boat lift portion of the inside guide rail has an end spaced rearwardly of an end of the boatlift, whereas, the outside guide rail has an end which is substantially even with the forward end of the boat lift.

In an illustrative embodiment, the guide rails each comprise an upper grab bar and a lower grab bar. The lower grab bar extends at least the length of the approach portion of the guide rails, and can extend to the end of the boatlift ramp (i.e., where the ramp and the cradle meet). The upper grab bar extending at least the length of the boatlift portion of the guide rails, and can extend substantially the length of the guide rail.

The boatlift can further include a barrier rail which is associated with the outside guide rail. The barrier rail comprises a horizontal bar spaced above the top bar of the guide rail, and can be mounted to the boatlift decking or to the outside guide rail. If the barrier rail is mounted to the outside guide rail, then the horizontal bar of the barrier rail is higher than it is if the barrier rail is mounted to the boatlift decking. The barrier rail can be independent of or integral with the guide rail.

The boatlift can also be provided with an entrance/exit assist member located proximate a forward end of one of the guide rails. The entrance/exit assist member comprises a pair of opposed legs extending upwardly on opposite sides of the boatlift cradle and a cross-member extending between the legs and over the cradle. The legs are of sufficient height such that a paddle or oar powered watercraft can pass under the cross-member, and whereby the cross-member is at a height to be reachable by a boater sitting in the watercraft.

In addition, the dock to which the boatlift is adjacent can include at least one bench. The bench is positioned to be adjacent the assist member and extends generally perpendicularly to the boatlift. The bench extends from the dock and over an edge of the dock such that a portion of the bench extends over the boatlift cradle. Hence, a boater can sit at the far end of the bench and be positioned over the watercraft. The boater can then use the assist member to help lower himself/herself into the watercraft.

In one illustrative embodiment, the bench comprises a bench body having a front surface, a back surface, side surfaces, a top surface and a bottom surface. The front surface extends generally parallel to an edge of the dock and defines at least one slot. Illustratively, the bench upper surface can include a first outer portion and a second inner portion; wherein the inner portion is generally parallel to and vertically below the outer portion. This provides a bench with two different heights.

The bench body is supported by legs which are mounted to the decking. The legs can comprise an upper portion and a lower portion which are telescopingly connected. The upper portion can be movable relative to the lower portion such that the effective height of the legs (and hence, the height of the bench) can be changed.

The bench body houses at least one extendable/retractable slide which extends through the at least one slot. The slide is supported by at a support which supports at least one slide within the bench body to be aligned with the at least one slot so that it may be pulled from the slot to be used. Illustratively, the bench can include two slides, one being an upper slide and one being a lower slide. The front surface of the bench body would include two slots, one slot for each slide; and two supports with in the body to support the two slides.

Preferably, the slide includes a grab member (such as a handle or tether) at the end of the slide that is exposed. To facilitate extension and retraction of the slide, the support comprises low friction elements; preferably in the form of non-moving guide rails which are made of a low-friction material, such as Teflon.

The slide extends from the bench and reaches across the boatlift. A slide support is positioned on a side of the boatlift opposite the bench to support the slide when extended. The slide support comprises at least one horizontal surface upon which the end of the slide rests when it is extended. The slide can include an arm which extends generally horizontally from the end of the slide. The arm then engages the at least one generally horizontal surface of the slide support when the at least one slide is extended. In an illustrative embodiment, the slide support comprises a pair of upwardly extending rails and at least one generally horizontal rung extending between the rails. The at least one rung comprising the at least one generally horizontal surface, and the slide arm engages the at least one rung.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
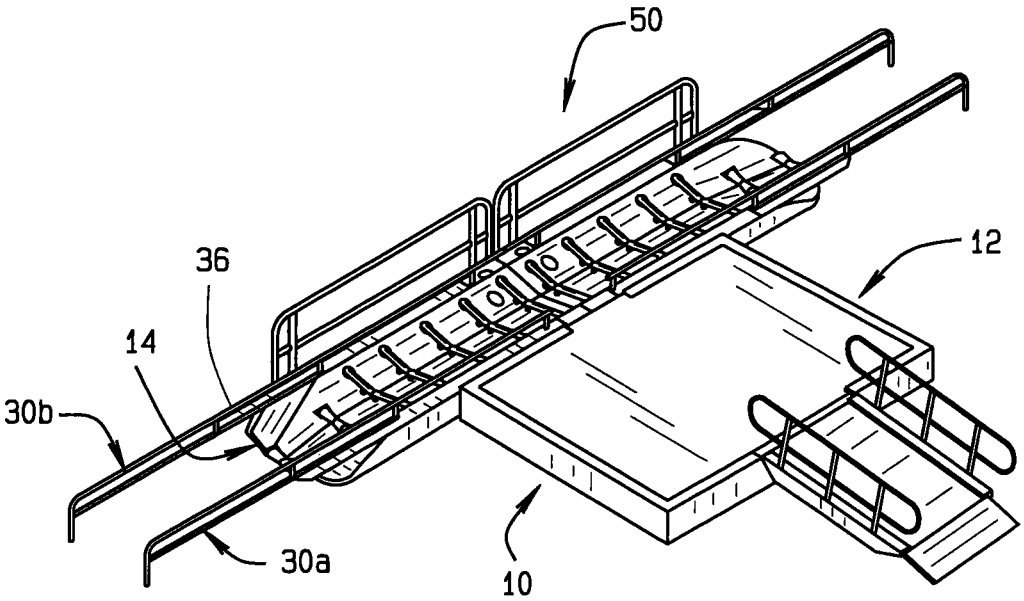
FIG. 1 is a perspective view of a boat lift provided with an illustrative guide rail system.

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

A dock system 10 for small watercraft includes a dock 12 and a boat lift 14. The dock 12 can be a floating dock, such as sold by EZ Dock, and which is comprised of a plurality of dock sections 12*a* which are connected together to form a dock of a desired shape and size. Preferably, the dock system 10 is provided with a gang plank or ramp 13 to facilitate entry onto and exit from the dock 12. A transition member 15 can be provided between the gang plank 13 and the dock 12. Such a dock can be made, for example, in accordance with U.S. Pat. Nos. 5,281,055 and 7,234,608 which are incorporated herein by reference.

Figure 3:
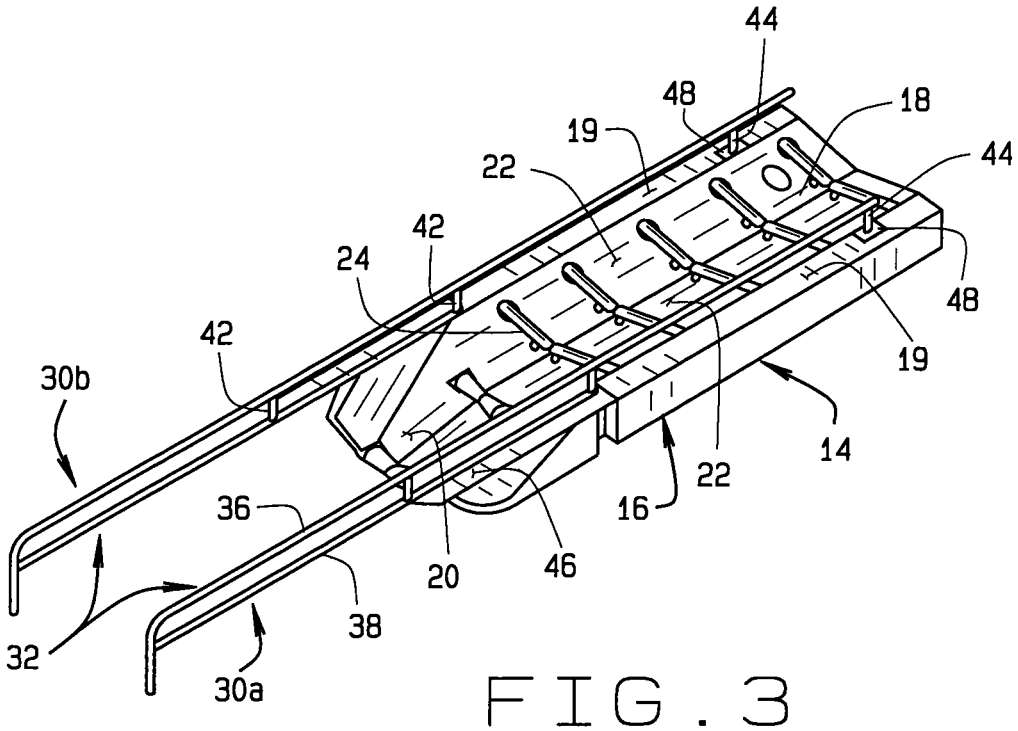
FIG. 3 is a perspective view of one illustrative embodiment of the guide rail system.

The boat lift 14 is secured to the dock 12, in accordance with the docking system from which the dock 10 is made. The boat lift 14 comprises a body 16 having a boat cradle 18 which, as shown, extends the length of the boat lift. A deck 19 extends along the outer edge of the cradle 18 on either side of the cradle 18. The boat lift is preferably a boat lift, such as described in US Pub. No. 20090044740, which is incorporated herein by reference, or which is sold by EZ Dock, Inc. under the name EZ Port Max. An entrance ramp 20 is at one end of the cradle. The cradle 18 has a pair of opposed, inwardly sloping walls 22 with rollers 24 positioned along each wall. The rollers can comprise elongate cylinders 26 (FIG. 3) which extend transversely along the sloping walls of the boat lift cradle 18. These rollers 26 have inner ends that are proximate the center of the cradle, but which are spaced from each other a sufficient distance to enable the rollers to rotate about an axis. Alternatively, the rollers 26 can be football or torpedo-shaped, such as described in US Pub. No. 20090044739, which is incorporated herein by reference.

The boat lift 14 is provided with guide rails 30*a,b* on either side of the cradle 18. The guide rails 30*a,b* are substantially the same. However, as will become apparent, the guide rail 30*b* is slightly longer than the guide rail 30*a*. The guide rail 30*b* can thus be considered an "outside" guide rail which is positioned on the far side of the boat lift 14 from the dock 12; and the guide rail 30*a* can be considered an "inside" guide rail which is on the dock side of the boat lift 14. Although the guide rails 30*a,b* are shown mounted on the right and left sides of the boatlift, respectively (with reference to FIG. 3), the guide rails 30*a,b* could alternatively be mounted on the left and right sides, respectively of the boatlift. The respective placement of the guide rails 30*a,b* depends on which way the boatlift is "facing" or which side of the boatlift is adjacent the dock 12.

The guide rails 30*a,b* are longer than the boat lift 14, and include an approach portion 32 in front of the boat lift ramp 20, and a boat lift section 34. In the outside guide rail 30*b*, the boat lift section of the guide rail extends substantially to the end of the boat lift. The inside guide rail 30*a*, on the other hand, ends short of the end of the boat lift. As seen in FIG. 1, when two boat lifts are connected end-to-end, the shorter inside guide rails provide an pass-through area from the dock 12 through which boaters can pass to access to watercraft.

Figure 2:
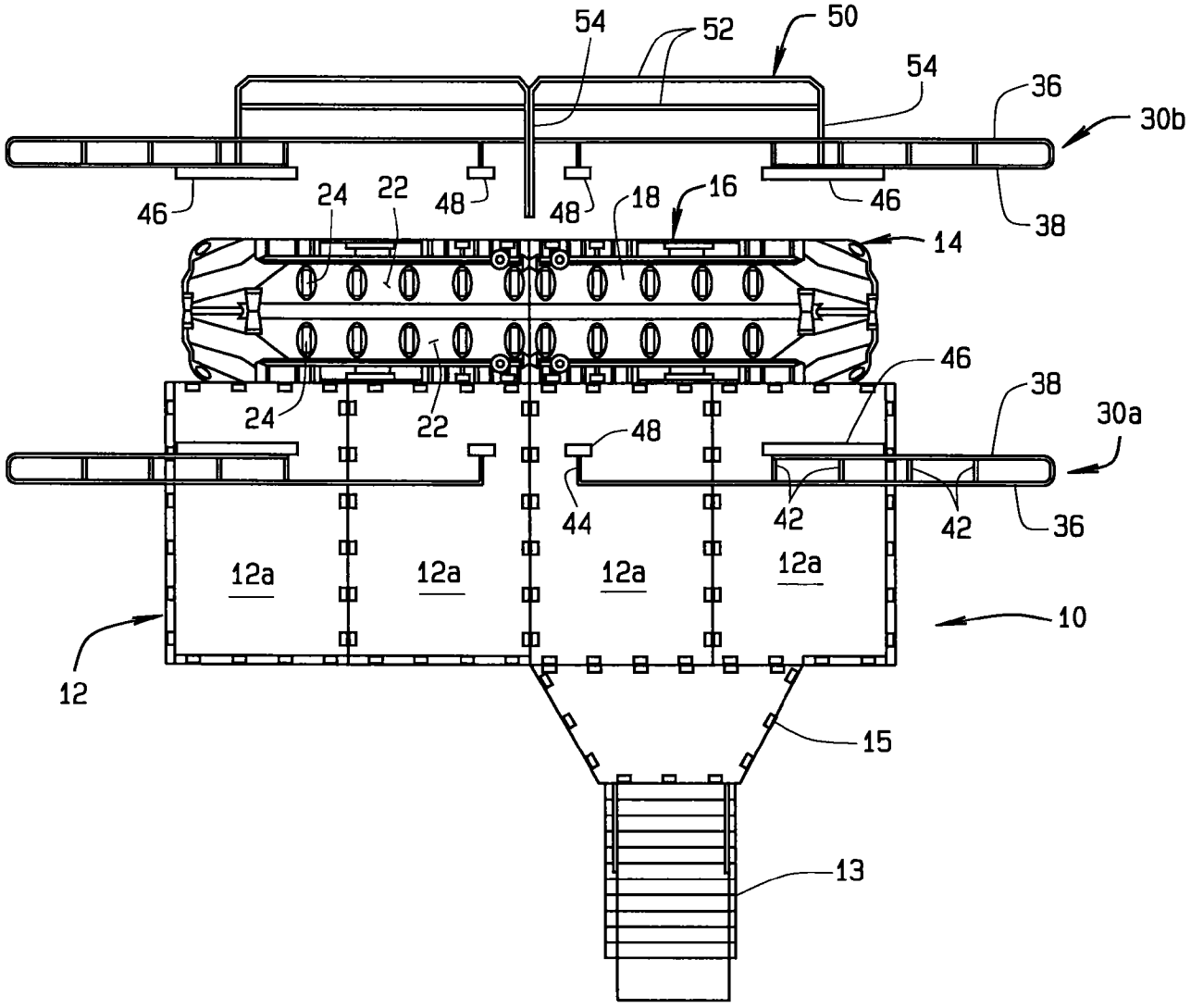
FIG. 2 is a schematic drawing of guide rails of the guide rail system with a plan view of a boat lift and dock.

The guide rails each include a top grab bar 36 which extends substantially the full length of the guide rail 30 and a lower grab bar 38 which extends the length of the approach section 32 of the guide rails. The lower grab bar 38 is essentially level with the boat lift deck 19, and extends substantially the length of the on-ramp section to the cradle 18. The guide rail additionally can include a front pole 40 at the front end of the guide rail 30 to which both the upper and lower grab bars are connected. (FIG. 1) Alternatively, as seen in FIG. 2, the front end of the guide rail can simply be closed by a section of the bar. In this instance, the grab bars 36 and 38 can be formed from a single long section of tubing which is bent to form the two grab bars. Connector posts 42 extend between the upper and lower grab bars 36,38, and an end post 44 is positioned near the end of the guide rail. On the inside guide rail 30*a*, the top grab bar 36 ends at the end post 44, whereas, on the outside guide rail 30*b*, the top grab bar extends beyond the end post 44. Lastly, the guide rails 30*a,b* include a mounting plate 46 which extends between the two connector posts 42, and a mounting plate 48 at the bottom of the post 44 to facilitate mounting of the guide rail to the boat lift 14. The mounting plates 46 and 48 are generally perpendicular to the posts 42 and 44, such that when the mounting plates are secured to the deck portion 19 of the boatlift 14, the guide rails 30*a,b* will be generally perpendicular to the boatlift (and will be generally vertical).

Figure 4A:
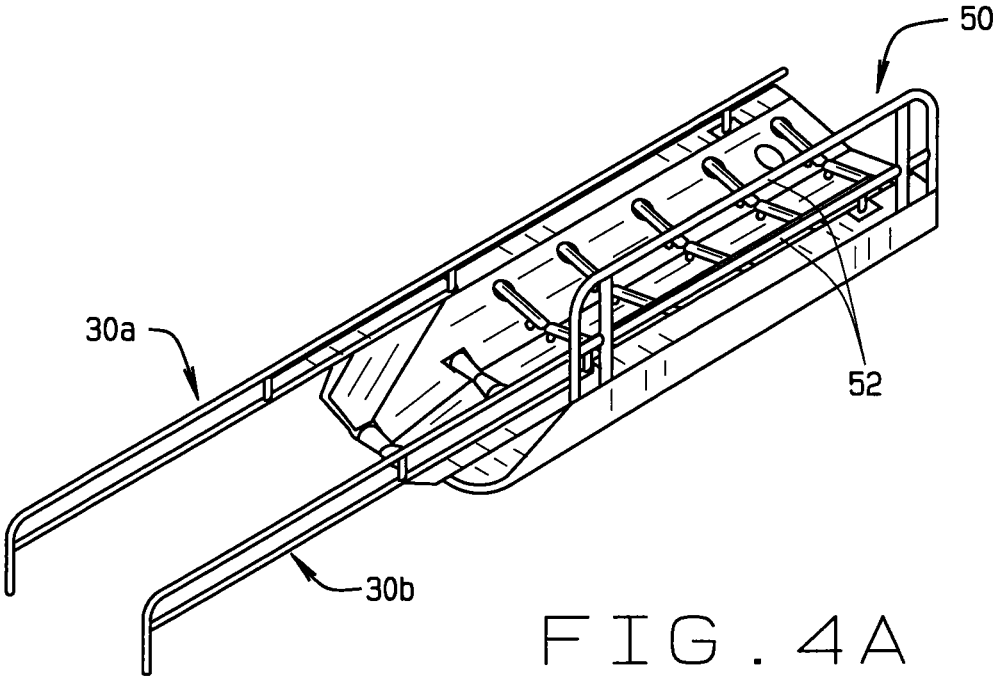
FIGS. 4*a,b* are perspective view of the guide rail system provided with barrier rails, the two figures showing the barrier rail mounted in two different positions relative to the guide rails.
Figure 4B:
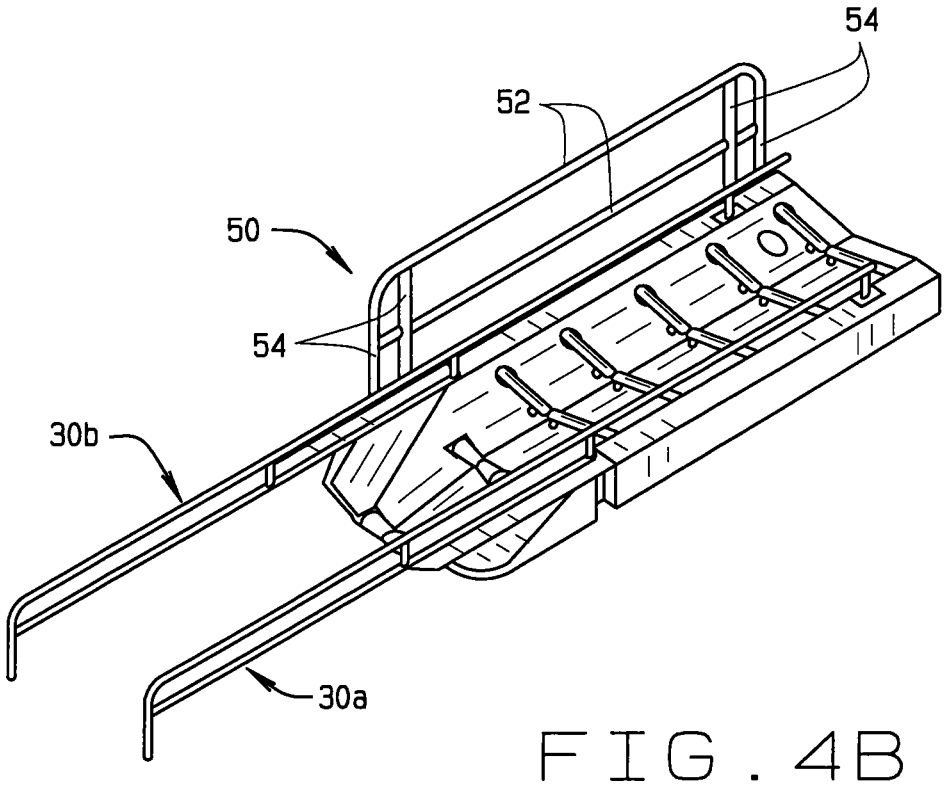

As shown in FIGS. 1 and 4*a,b*, a barrier rail 50 can be provided. The barrier rail 50 includes a pair of vertically spaced apart, horizontally extending bars 52 which are connected, at their opposite ends, by vertical posts 54. The barrier rail 50 extends the length of the boatlift cradle 18 (or generally from the end of the boatlift ramp 20 to the opposite end of the boatlift 14. As shown in FIG. 4*a*, the barrier rail 50 can be mounted directly to the boat lift, in which case, the barrier rail lower bar is generally level with the lower grab bar of the guide rail approach portion. In this instance, this lower bar of the barrier rail could operate as a continuation of the lower grab bar. Alternatively, as shown in FIG. 4*b*, the barrier rail can be mounted to the guide rail 30, such that the bottom of the vertical posts 54 of the barrier rail are approximately level with the top bar of the guide rail. Here, the barrier rail is described as being separate from the guide rail. However, the barrier rail could be formed with, or as a part of, the guide rail. As seen, the barrier rail is associated with the outside guiderail 30*b*.

Figure 5:
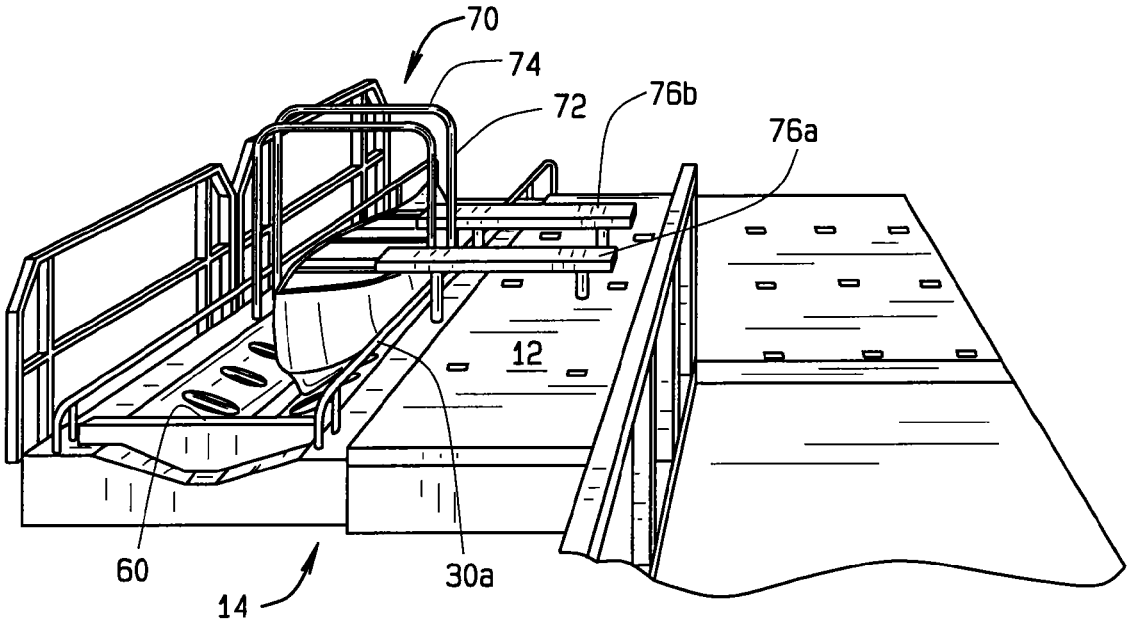
FIGS. 5 and 6 are front and side perspective views of the guide rail system provided with assist members to facilitate entry into and exit from small watercraft and benches on the dock to facilitate use of the assist members.

As shown in FIG. 1, two boat lifts can be connected in tandem to form a single boat lift that is open at both ends. In this instance, one end of the boat lift serves as an entrance, and the opposite end serves as an exit. Alternatively, if the boatlift does not include a ramp at its forward end, as seen in FIG. 5, the boatlift can be provided with a stop 60 to prevent the watercraft from being propelled forwardly off the end of the boatlift. The stop 60 can simply be a bar which extends across the forward end of the boatlift between the inside and outside guide rails 30*a,b*, as seen in FIG. 5. Alternatively, the stop 60 can comprise a bow stop, as disclosed in the above noted US Pub. No. 20090044740, which is incorporated herein by reference.

When the guide rails 30 are mounted to the boat lift 14, the lower grab bars 38 of the approach portion 32 are approximately at the level of the canoe, kayak, etc. so that they can easily be grasped by a boater sitting in the canoe, kayak, etc. Further, the two guide rails are spaced apart a distance which will allow the boat to pass between the rails 30, yet which will allow the boater to grab both rails at the same time. Hence, by grabbing the lower grab bars 38 of the approach portion of the guide rails 30, the boater can propel his/her boat forward with sufficient force to drive the watercraft onto the on-ramp of the boatlift. By grabbing a forward section of the grab bars 36, 38, the boater can continue to propel his/her boat along the boatlift until the watercraft (i.e., canoe, kayak, etc.) is fully on the boatlift. As can be appreciated, as the watercraft is propelled onto the boatlift, the level of the watercraft, and hence, the boater, will be raised. Hence, as the boater moves the watercraft along the boatlift, the boater can change from initially using the lower grab bars 38 to using the upper grab bars 36 of the guide rails 30. When a boater desires to launch the watercraft, the boater need only get into the watercraft, and using the guide rails 30*a,b*, propels the boat off the boatlift. In the embodiment of FIG. 1 (which has ramps at both ends of the boatlift) the boater can go forward, whereas in the embodiment of FIG. 5 (which has a stop extending across the forward end of the boatlift), the boater will need to go backwards to exit the boat lift. In either case, the rollers facilitate moving the watercraft along the boat lift, such that moving the watercraft along the boatlift is not unduly strenuous.

Figure 6:
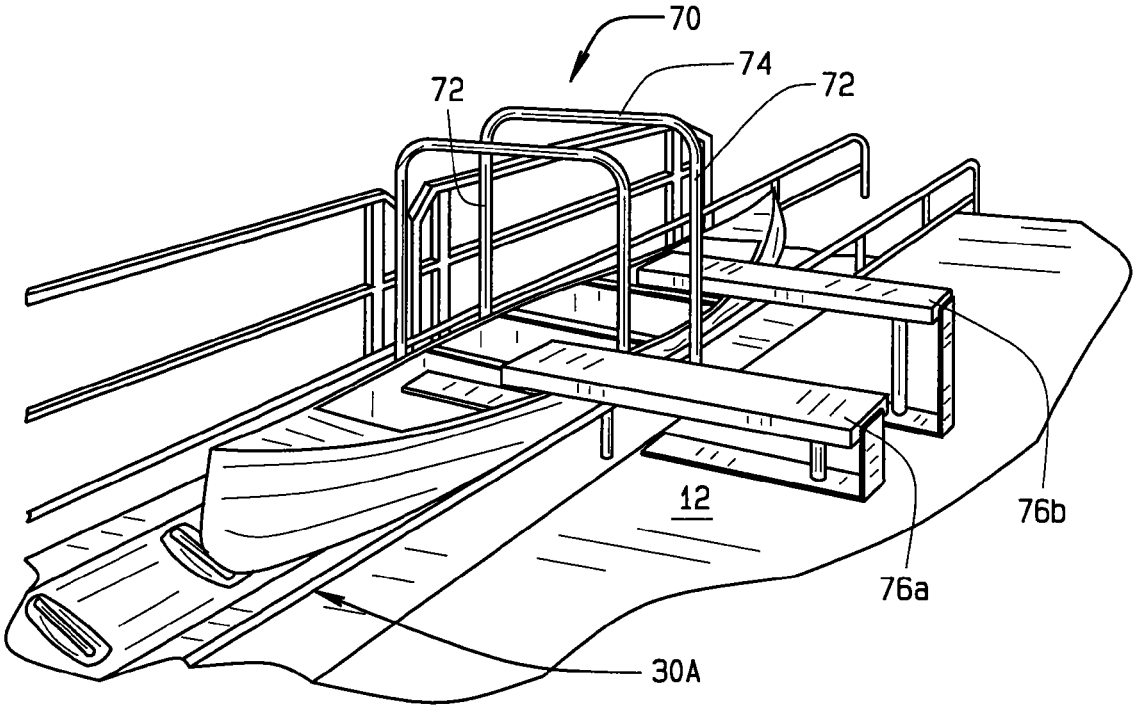

The embodiment of FIGS. 1-4*b* works well for able bodied boaters. However, it does not facilitate boaters with impaired leg function, are in a wheel chair, or otherwise have difficulty in getting into and out of small watercraft. In FIGS. 5 and 6, the boatlift is provided with an entrance/exit assist member 70 comprised of vertical legs 72 and a cross-member 74 extending between the legs 72. The legs 72 extend upwardly from the boatlift on opposite sides of the boatlift cradle 18, and the cross-member 74 extends over the cradle 18. The assist member 70 is positioned at the end of the inside guide rail 30*a*. Thus, in FIGS. 5 and 6, where two boatlifts are interconnected, and the inside guide rails form a pass through area, the assist members 70 are at this pass-through area. As seen, a boat can pass under the assist members 70. The assist members 70 are sized such that the cross-member 74 is at a height which will allow for a boater sitting on a bench in the boat to reach up and grab the cross-member 74.

The dock is further provided with a pair of benches 76*a,b* positioned adjacent the assist members 70. The benches 76*a,b* each extend across a portion of the dock 12 so that the benches can be used by people on the dock 12. In addition, the benches 76*a,b* extend past the edge of the dock and over the decking of the boatlift, such that the edge of the benches are over the gunwales of the boat. In FIGS. 5 and 6, the benches 76*a,b* are of different heights, with the bench 76*b* being higher than the bench 76*a*. This allows for the benches to accommodate people of different abilities. For example, one of the benches may be easier for someone in a wheelchair to use, while the other bench may be easier for someone who walks, but otherwise needs assistance in getting into and out of the watercraft.

To use the entry/exit assist, the boat is positioned at the pass-through between the inside guide rails 30*a* with the boat seats generally beneath the assist members 70. With the boat in position, a boater can seat himself/herself on one of the benches 76*a,b* and slide over to the edge of the bench. By holding on to the cross-member 74, the boater can lower himself/herself from the bench 76*a,b* to the boat seat.

Figure 7:
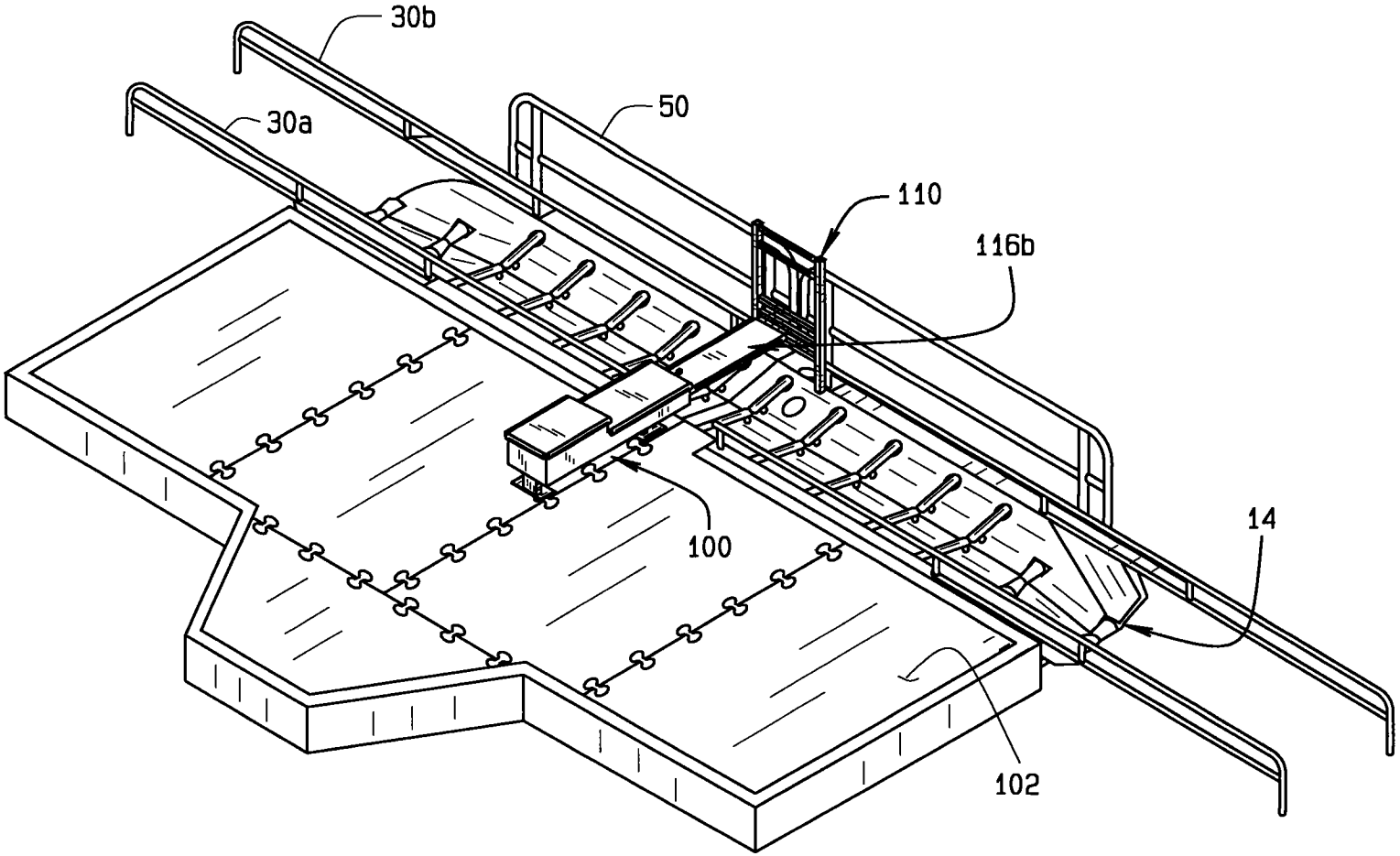
FIG. 7 is a perspective view of a deck fitted with the guide rail system and a second embodiment of a deck bench, the deck bench facilitating embarking and disembarking of disabled boaters.
Figure 8:
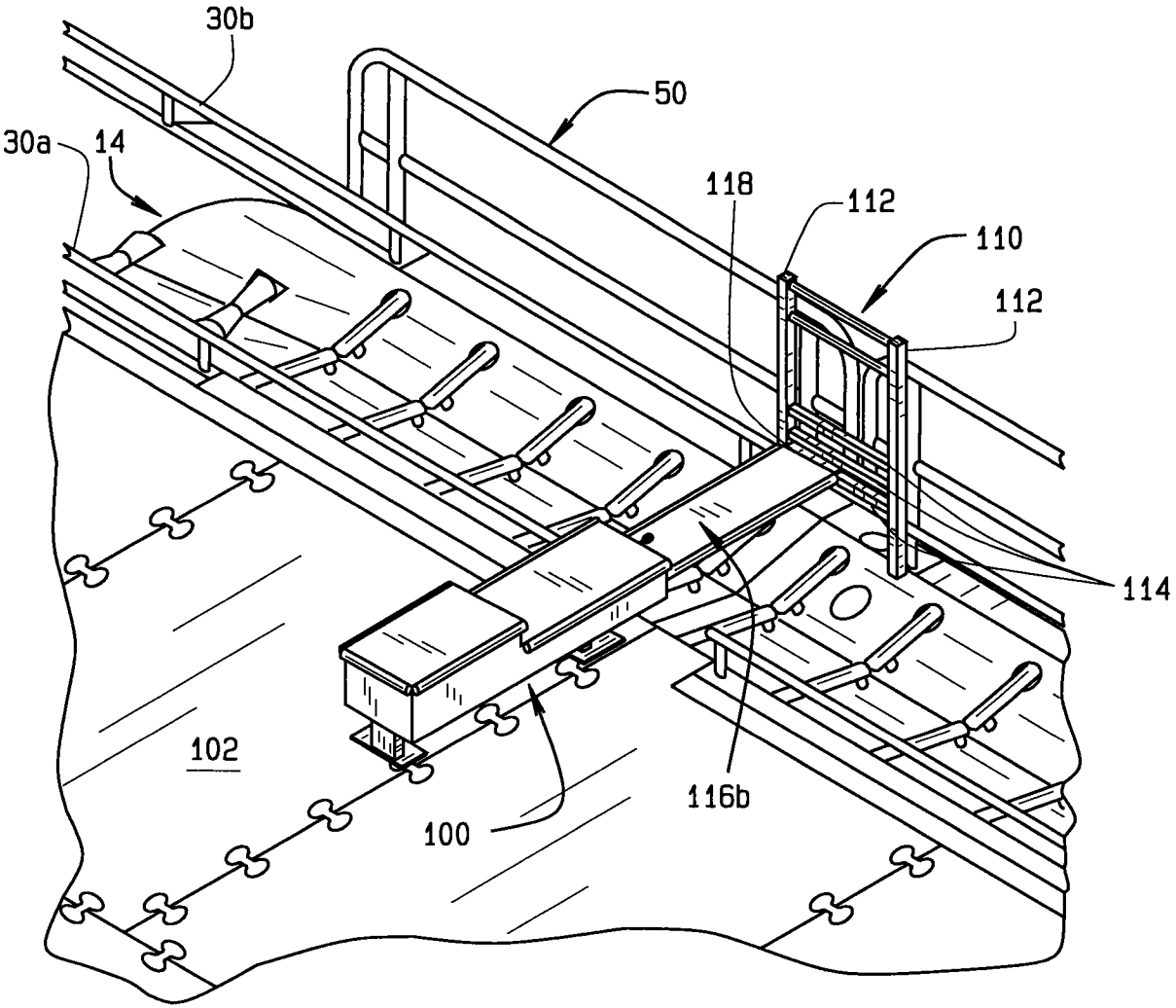
FIG. 8 is an enlarged view of the deck bench and guide rail system.
Figure 9:
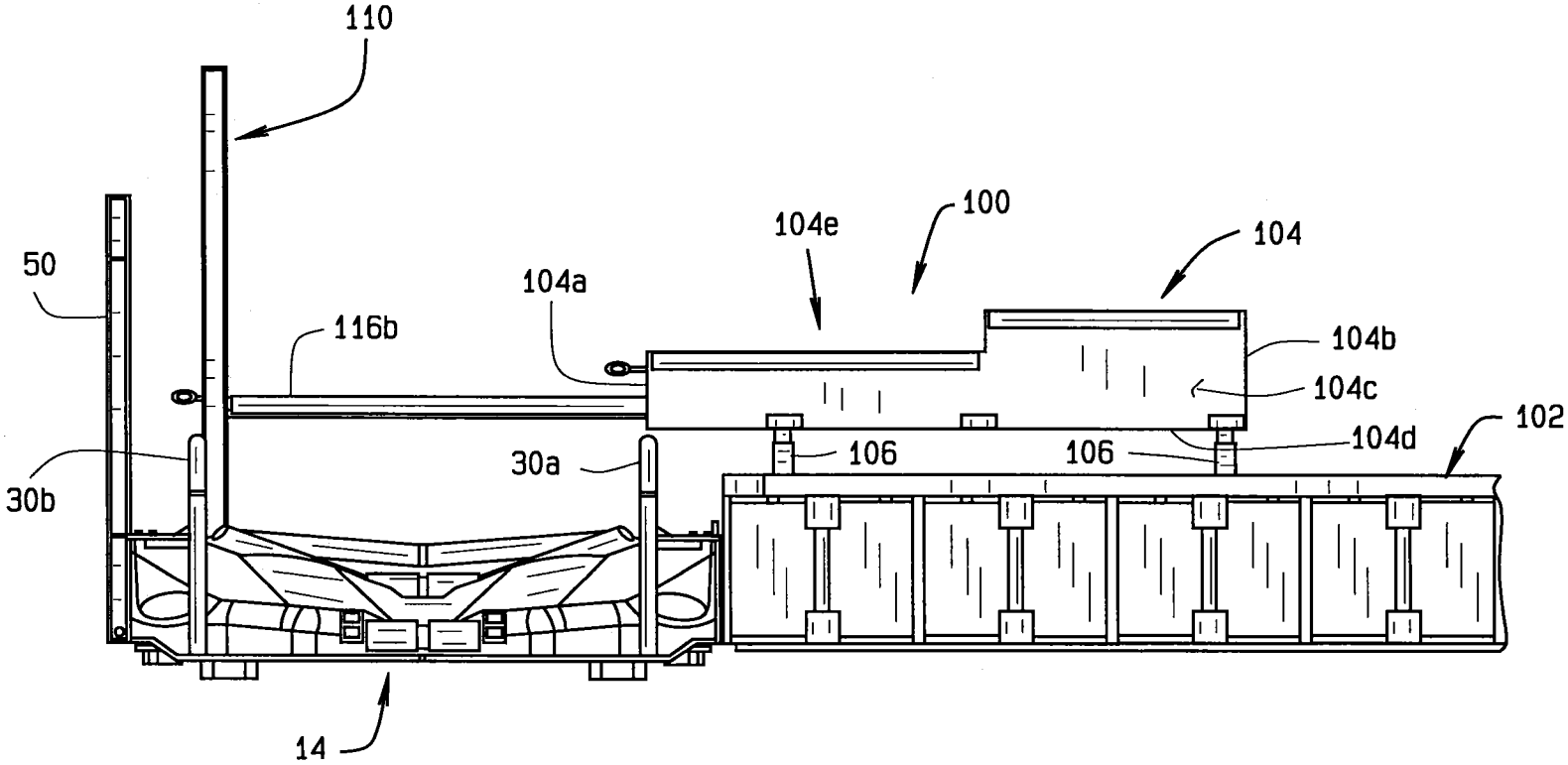
FIG. 9 is an end view of the guide rail system with the deck bench of FIG. 8 showing a slide of the deck bench in fully extending position.
Figure 10:
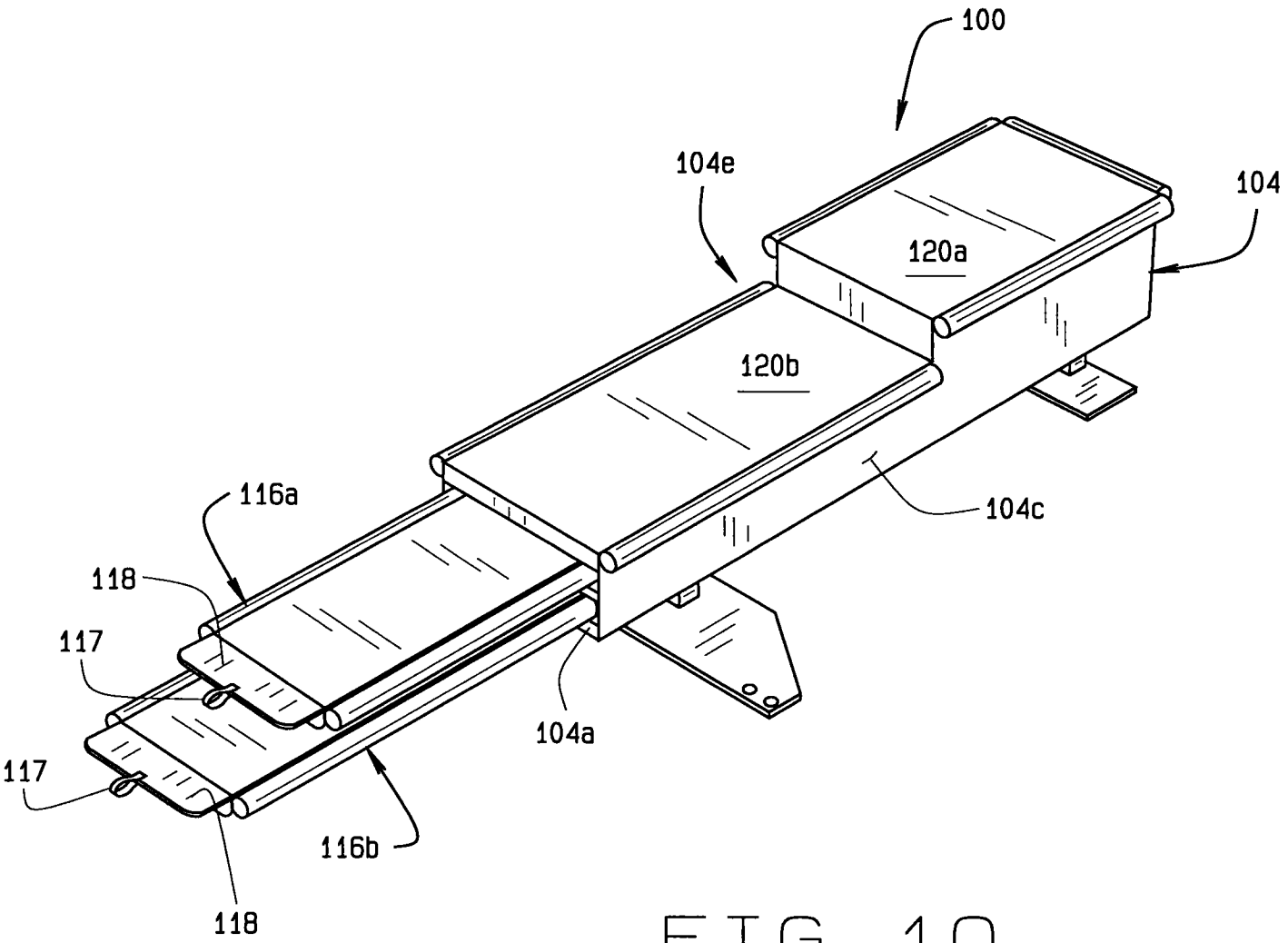
FIG. 10 is a perspective view of the bench, with both slides extended for purposes of illustration.
Figure 11:
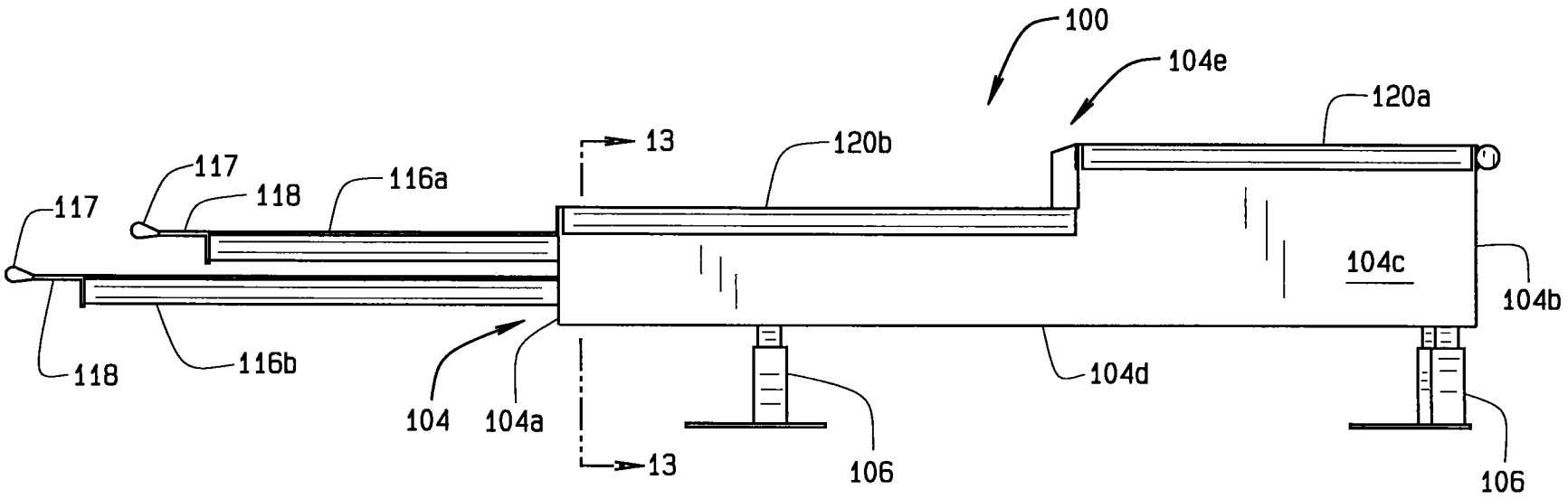
FIG. 11 is a side elevational view of the bench.

An alternative bench 100 is shown generally in FIGS. 7-9 mounted on a deck platform 102. The bench 100 includes an elongate body 104 defining front 104*a*, back 104*b*, sides 104*c*, bottom 104*d* and top 104*e* surfaces. A pair of legs 106 extend downwardly from the body 104 to support the bench body 104 above the surface of a deck 102. Upper and lower slots 105*a,b* are formed in the bench body front surface 104*a*. As best seen in FIG. 9, the bench body 104 extends beyond the edge of the deck platform 102, such that the front surface 104*a* of the bench body 104 is approximately flush with the inside guide rail 30*a*.

A slide support 110 in the form of a ladder is positioned on the opposite side of the boatlift 14 from the bench 100. The ladder 110 includes a pair of side rails 112 which extend up from the surface of the boat lift 14 and a plurality of rungs 114 extending between the rails 112. As will be described in more detail below, the bench 100 includes extendable/retractable slides 116*a,b* which extend across the boatlift 14 from the front surface 104*a* of the bench 100 to be supported by one of the rungs 114 of the ladder 110. The slides, as seen, define a generally planer top surface having elongate side edges. As described below, the slides are configured so that a boater can sit on the slide (when it is extended) to lower him/herself into a watercraft. Conversely, the boater can raise him/herself out of the watercraft to then sit on the extended slide.

The slides 116*a,b* are stored within the bench body 104, and extend and retract through the slots 105*a,b* in the bench body front surface 104*a*. The slides 116*a,b* are accessible through the slots 105*a,b* when the slides are stored in the bench body. The slides can be retracted fully into the slide (and be reached through the slots) or the slide can protrude slightly from the slot when the slide is in a retracted position. As will be described below, when extended, the slides 116*a,b* reach or extend across the boatlift 14 to enable a disabled boater (such as one who does not have use of his/her legs) to get in and get out of a small boat, such as a kayak or a canoe. To facilitate extending of the slides 116*a,b*, each slide includes a grip 117. The grips 117 are shown as flexible loops, but could comprise handles, pull rods, etc. The slides also include arms 118 at the end of each slide. The arms 118 extend from the slides such that they are generally flush or level with the top surface of the slides. The arms 118 rest on the rungs 114 of the ladder 110 when the slides are extended. The grips 116 are illustratively mounted to the ends of the arms 118. As can be appreciated, the arms 118, and the connection between the arms 118 and the slides 116*a,b* are sufficiently robust to support a person on the slide with the slide extended.

The bench 100 is shown in more detail in FIGS., 10-14. The bench top surface 104*e* includes a first portion 120*a* and a second portion 120*b*. The second portion 120*b* extends over the edge of the deck, and the first portion 120*a* extends inwardly from the inner end of the second portion 120*b*. As seen, the second portion 120*b* is below the first portion 120*a*. Preferably, the bench top second portion 120*b* is no more than about 5" (about 12.7 cm) below the bench top first portion 120*a*. As is clear from the drawings, the bench top second portion is spaced below the first portion, and forward of the first portion, such that both the first and second portion are accessible at the same time. The bench 100 is designed for use by persons who do not have the use of their legs (such as paraplegics). It has been determined that the average maximum height a person can raise him or herself off a surface using his or her arms is about 5". Hence, the bench top first surface is about 5" above the bench top second surface.

Wheel chairs have one of two typical seat heights. Hence, the different heights of the bench top surface enable users of wheel chairs with either seat height to more easily transfer from their wheel chairs to the bench. Thus, one who uses a wheel chair having a higher seat height can transfer from his/her wheel chair to the higher first surface 120*a* of the bench top 104*e*; and one who uses a wheel chair having a lower seat height can transfer from his/her wheel chair to the lower second surface 120*b* of the bench top 104*e*. Hence, the difference in height between the two benches is designed to enable a disabled individual to elevate himself or herself from the lower bench top 120*b* to the upper bench top 120*a* (or vice versa), just by pushing up with his/her arms.

Figure 12:
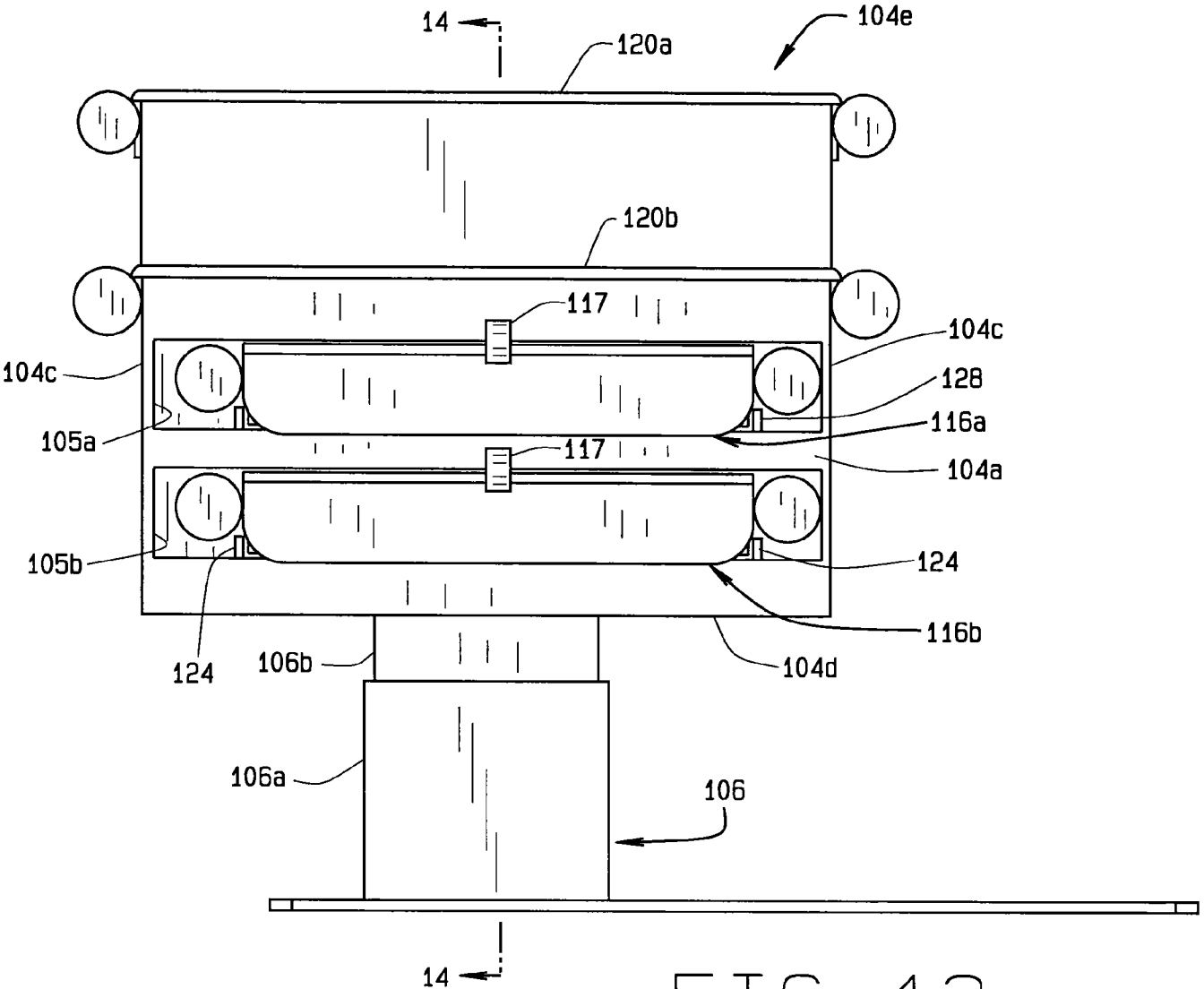
FIG. 12 is an end elevational view of the bench.
Figure 13:
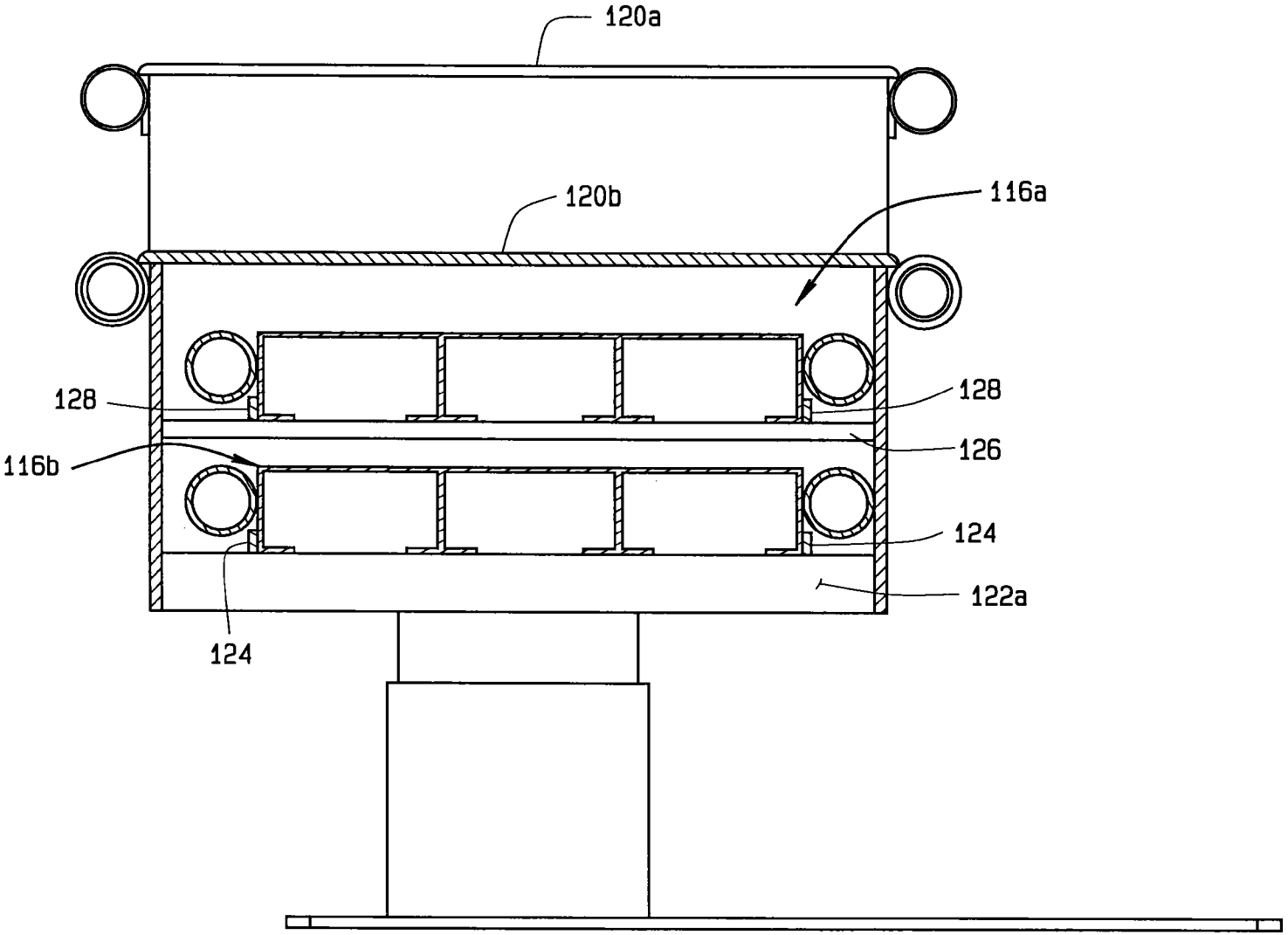
FIG. 13 is a cross-sectional view of the bench taken along line 13-13 of FIG. 11.
Figure 14:
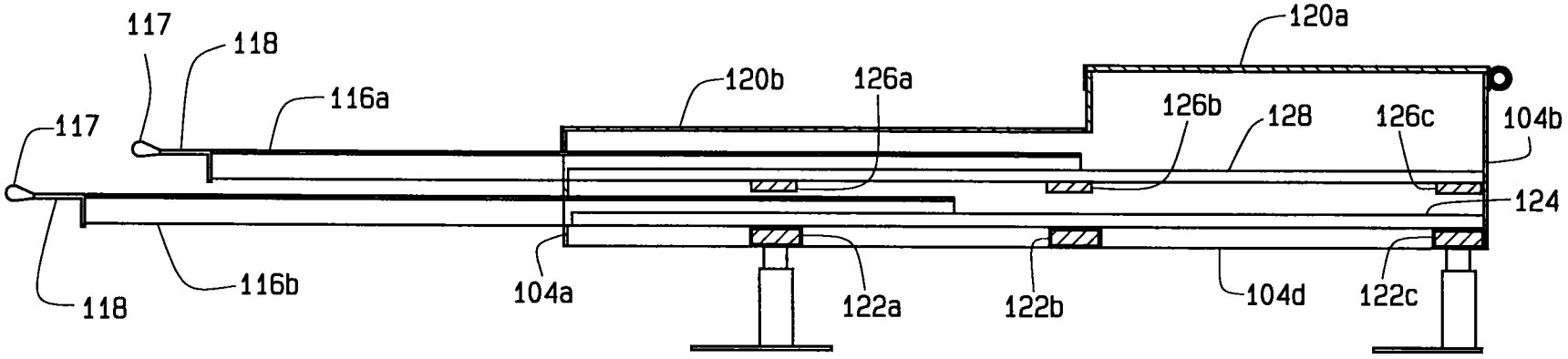
FIG. 14 is a cross-sectional view of the bench taken along line 14-14 of FIG. 12.

Turning to FIGS. 12-14, internally, the bench body 104 includes lower cross-members 122*a-c* which are spaced apart, and extend across, the body bottom surface 104*d*. As seen in the drawings, the lower cross-members extend substantially the full width of the bench body, between the opposite side surfaces 104*c*. The lower slide 116*b* rests (and slides) on the lower cross-members 122*a-c*. Hence, the upper surface of the cross-members 122*a-c* is substantially even or flush with the lower edge of the lower slot 105*b* in the body front surface 104*c*. Rails 124 are positioned on either side of the slide 116*b* to maintain alignment of the slide 116*b* within the bench body. The upper slide 116*a* is supported by (and slides on) cross-members 126*a-c* which extend the width of the bench body between the side surface 104*c*. The upper cross-members 126*a-c* can be fixed to the side surfaces 104*c*. To maintain the upper slide 116*a* in vertical alignment upper slot 105*a* of the front surface, the upper surface of the cross-members 126*a-c* is substantially even or flush with the lower edge of the upper slot 105*a* in the body front surface 104*c*. Rails 128 are mounted to the top of the cross-members on either side of the slide 116*a* maintain the horizontal position of the slide 116*a* relative to the body and the front upper slot 105*a*. To facilitate sliding of the slides 116*a,b*, the supports and rails are preferably made from a low friction material, such as Teflon.

Although supports (in the form of cross-members) and rails are shown to maintain the vertical and horizontal position of the slides 116*a,b* in the bench body 104, the slides could be supported by other means. For example, the slides could be supported by rails, which, could be formed from L-beams, for example. Such L-beams would also be made from a low friction material, such as Teflon. The use of a low friction material avoids the use of moving parts, which may have a shortened life in marine environments. However, if desired, cross-members 122*a-c* and 126*a-c* could be replaced with rollers. Alternatively, spaced apart bearing assemblies could be provided on which the slides 116*a,b* slide.

The use of low friction guides, whether the low friction guide be made from a low friction material or be comprised of rollers or bearing assemblies, allows for the slides to be extended from, and retracted into, the bench body easily. This is relatively important, because when exiting a water craft, the boater will be below, and in front of the slides, and hence, will have to reach up to grasp the slide, and will have to extend the slide behind the boater.

In use, when a boater is entering a kayak or canoe that is positioned in the boat lift 14, the boater will first extend one of the two slides 116*a,b* until the arm 118 of the slide is positioned on a rung 114 of the ladder 110. With the slide supported at one end by the bench 104 and at the opposite end by the ladder 110, the boater can slide out over the kayak or canoe on the slide 116*a,b*. Once the boater is over the seat of the kayak or canoe, the boater can lower himself/herself into the boat.

To exit a small boat, the boater will approach the boat lift 14, and position the small boat on the boat lift such that the boater is slightly in front of the bench 100 and ladder 110. With the boater so positioned, the boater can reach up and pull out the slide. The slide will extend behind the boater. When the slide is positioned, the boater can raise himself/herself up onto the slide 116*a,b*. Once the boater is on the slide, the boater can then scoot over towards the bench body 104.

As noted there are two slides 116*a,b*. Only one slide will be extended at a time. The slide that is extended will depend on the size of the boat the boater is entering or exiting. If the boat seat is low, the boater may use the lower slide 116*b*. If the boat seat is higher, the boater may use the upper slide 116*a*.

To add greater flexibility to the use of the bench 100, the legs 106 are telescoping legs. The legs comprise a lower section 106*a* and an upper section 106*b*. Illustratively, the upper leg section is received in the lower leg section, but this could be reversed. The leg sections can include a series of discrete holes and pins which extend through the holes when aligned. Any other alternative structure of changing the effective length of the legs can be used as well. Preferably, the legs allow for a change in effective length of about 5".

As various changes could be made in the above constructions without departing from the scope of the invention, it is intended that all matter contained in the above description or shown in the accompanying drawings shall be interpreted as illustrative and not in a limiting sense. For example, although the inside guide rail 30*a* is described to be mounted or secured to the boatlift, the inside guide rail 30*a* could be secured to the edge of the dock 12. Although the guide rails include upper and lower grab bars, the guide rails could each be provided with a single grab bar. In this case, the single grab bar would preferably be contoured, such that the section of the grab bar in the approach portion of the guide rail is below the section of the grab bar in the boatlift portion of the guide rail. These examples are merely illustrative.

The invention claimed is:

1. A docking system comprising a boatlift for paddle or oar powered watercraft positionable adjacent a dock and a bench system mounted on said dock;

the boatlift comprising an elongate cradle, decking on opposite sides of said cradle, an entrance ramp to said cradle, and a first guide rail positioned on one side of said cradle and a second guide rail positioned on a second side of said cradle opposite said first side; said first and second guide rails each comprising an approach portion extending rearwardly of said boatlift ramp and a boatlift portion extending along said boatlift cradle; each said guide rail further comprising at least one grab bar extending generally horizontally along said rail; said at least one grab bar being positioned on said guide rail to be at a height where a boater sitting in a paddle or oar powered watercraft could reach said grab bar; said first and second guide rails being spaced apart from each other a distance sufficient to allow a paddle or oar powered boat to pass therebetween, yet allowing a boater to simultaneously grab the grab bars of both said first and second guide rails;

said bench system comprising;

a bench positioned adjacent a first side of said boatlift; said bench having an elongate bench body having a front surface, a back surface, side surfaces, a top surface and a bottom surface which in combination delimit an interior of said bench body; said body side surfaces defining a length greater than a width of said front surface; said to surface of said bench body defining an elongate, generally horizontal seating portion having a front edge and side edges; said front surface of said body defining at least one slot spaced below said front edge of said seating portion and which opens into said interior; and a first elongate slide and a second elongate slide, said second slide being below said first slide; each of said first and second elongate slides having a generally planar top surface which is generally parallel to said bench body top surface and elongate sides; each of said first and second slides being translationally supported in said bench body interior in alignment with said at least one slot; said slides being movable independently of each other through said at least one slot between a retracted position in which said slides are substantially received within said bench body interior and an extended position; said generally planar top surface of said slides being spaced vertically below said top surface of bench body such that said slides move in a substantially horizontal plane below a plane defined by said bench body top surface; said slides being configured such that a user can sit on the slides and dangle legs over at least one of the elongate edges of the slides when a selected one of said slides is in its said extended position; and a remote support member which supports said slides when said slides are in their extended positions; said support member being fixed in a position spaced horizontally from said front surface of said bench body when either of said slides are in their retracted position a distance no greater than a length of the slides; said support member comprising a first horizontal surface upon which said first slide removably rests when said slide is in an extended position and a second horizontal surface upon which said second slide removably rests when said second slide is in its said extended position; said first and second horizontal surfaces of said support member being positioned such that said first and second slides are substantially horizontal when in their said extended positions.

2. The docking system of claim 1 wherein said first guide rail is an inside guide rail and said second guide rail is an outside guide rail; said outside guide rail being longer than said inside guide rail; the boat lift portion of said inside guide rail having an end spaced rearwardly of an end of said boatlift and said outside guide rail having an end which is substantially even with said forward end of said boat lift.

3. The docking system of claim 1 wherein said at least one grab bar comprises an upper grab bar and a lower grab bar; said lower grab bar extending at least the length of said approach portion of said guide rails; and said upper grab bar extending at least the length of said boatlift portion of said guide rails.

4. The docking system of claim 3 wherein said lower guide rail extends from a rearward end of said guide rail to an approximate end of said boatlift ramp.

5. The docking system of claim 4 wherein said upper grab bar extends substantially the length of said guide rail.

6. The docking system of claim 3 wherein said upper grab bar extends substantially the length of said guide rail.

7. The docking system of claim 3 further comprising a barrier rail; said barrier rail comprising a horizontal bar spaced above said upper grab bar of said guide rail.

8. The docking system of claim 7 wherein said barrier rail is mounted to or integral with said guide rail.

9. The docking system of claim 1 including an entrance/exit assist member located proximate a forward end of one of said guide rails; said entrance/exit assist member comprising a pair of opposed legs extending upwardly on opposite sides of said boatlift cradle, and a cross-member extending between said legs and over said cradle; said legs being of sufficient height such that a paddle or oar powered watercraft can pass under said cross-member, and whereby said cross-member is at a height to be reachable by a boater sitting in said watercraft.

10. The docking system of claim 1 wherein said boatlift is adjacent a dock; said bench extending generally perpendicularly to said boatlift.

11. The docking system of claim 1 wherein said slides each comprise a grab member at an end of said slide; said grab members being accessible when their respective slides are in a retracted position.

12. The docking system of claim 1 wherein said bench body comprises an internal support for supporting at least one of said first and second slides in said bench body; said slide support comprising low friction elements to facilitate extension and retraction of said at least one of said first and second slides.

13. The docking system of claim 12 wherein said low friction elements comprise non-moving guide rails.

14. The docking system of claim 1 wherein said slides each comprise a horizontally extending arm; which engage the respective generally horizontal surface of said remote support member when a selected one of said slides is extended.

15. The docking system of claim 1 wherein said bench top surface comprises a first portion and a second portion; said first portion being generally parallel to and vertically below said second portion.

16. The docking system of claim 1 wherein said at least one slot comprises an upper slot and a lower slot; said first slide being extendable and retractable through said upper slot; and said second slide being extendable and retractable through said lower slot; said first and second slides being generally parallel to each other.

17. The docking system of claim 16 wherein said bench body comprises an upper internal support and a lower internal support; said upper internal support maintaining said first slide in alignment with said upper slot and said lower internal support maintaining said second slide in alignment with said lower slot.

18. The docking system of claim 1 wherein said bench body is supported by legs; said legs comprising an upper portion and a lower portion; said upper and lower portion being telescopingly connected; such that the effective height of said legs can be changed.

19. A bench system comprising;

a bench having:

an elongate bench body having a front surface, a back surface, side surfaces, a top surface and a bottom surface which in combination delimit an interior of said bench body; said body side surfaces defining a length greater than a width of said front surface; said top surface of said bench body defining an elongate, generally horizontal seating portion having a front edge and side edges; said front surface of said body defining at least one slot spaced below said front edge of said seating portion and which opens into said interior; and a first elongate slide and a second elongate slide, said second slide being below said first slide; each of said first and second elongate slides having a generally planar top surface which is generally parallel to said bench body top surface and elongate sides; each of said first and second slides being translationally supported in said bench body interior in alignment with said at least one slot; said slides being movable independently of each other through said at least one slot between a retracted position in which said slides are substantially received within said bench body interior and an extended position; said generally planar top surface of said slides being spaced vertically below said top surface of bench body such that said slides move in a substantially horizontal plane below a plane defined by said bench body top surface; said slides being configured such that a user can sit on the slides and dangle legs over at least one of the elongate edges of the slides when a selected one of said slides is in its said extended position; and a remote support member which supports said slides when said slides are in their extended positions; said support member being fixed in a position spaced horizontally from said front surface of said bench body when either of said slides are in their retracted position a distance no greater than a length of said slides; said support member comprising a first horizontal surface upon which said first slide removably rests when said first slide is in its said extended position and a second horizontal surface upon which said second slide removably rests when said second slide is in its said extended position; said first and second horizontal surfaces of said support member being positioned such that said first and second slides are substantially horizontal when in their said extended positions.

20. The bench system of claim 19 wherein said slides each comprise a grab member at an end of said slide;

said grab members being accessible when said slides are in their said retracted positions.

21. The bench system of claim 19 wherein said bench body comprises an internal support adapted to support at least one of said first and second slides in said bench body; said internal support comprising low friction elements to facilitate extension and retraction of said at least one of said first and second slides.

22. The bench system of claim 21 wherein said low friction elements comprise non-moving guide rails.

23. The bench system of claim 19 wherein at least one of said first and second slides comprises a main portion and an arm extending horizontally from a front edge of said main portion; said arm engaging its corresponding generally horizontal surface of said slide support when said at least one of said first and second slides is extended.

24. The bench system of claim 19 wherein said remote support member comprises a pair of upwardly extending rails; and first and second generally horizontal rungs extending between said rails; said first and second generally horizontal rungs comprising said first and second generally horizontal surfaces.

25. The bench system of claim 19 wherein said bench top surface comprises a first portion and a second portion; said first portion being generally parallel to and vertically below said second portion.

26. The bench system of claim 19 wherein said at least one slot comprises a first slot and a second slot; said second slot being below said first slot; said first slide being extendable and retractable through said first slot; and said second slide being extendable and retractable through said second slot; said first and second slides being generally parallel to each other.

27. The bench system of claim 26 comprising first and second internal support members adapted to slidably support said first and second slides, respectively, in said bench body; said first internal support maintaining said first slide in alignment with said first slot and said second internal support maintaining said second slide in alignment with said second slot.

28. The bench system of claim 19 wherein said bench body is supported by legs; said legs comprising an upper portion and a lower portion; said upper and lower portion being telescopingly connected; such that the effective height of said legs can be changed.

* * * * *